US005343718A

United States Patent [19]

Pöll

[11] Patent Number: 5,343,718

[45] Date of Patent: Sep. 6, 1994

[54] CHAIN LINK FOR GEMS, AND ORNAMENTAL CHAIN COMPRISING SUCH LINKS, AND A METHOD FOR PRODUCING SAID CHAIN

[75] Inventor: Martin Pöll, Fritzens, Austria

[73] Assignee: D. Swarovski & Co., Wattens, Austria

[21] Appl. No.: 90,481

[22] Filed: Jul. 12, 1993

Related U.S. Application Data

[63] Continuation of Ser. No. 836,064, Feb. 12, 1992, abandoned.

[30] Foreign Application Priority Data

Feb. 13, 1991 [DE] Fed. Rep. of Germany ..... 4104339

[51] Int. Cl.[5] ..... A44C 17/02; A44C 5/02

[52] U.S. Cl. ..... 63/26; 63/4; 63/27; 63/9

[58] Field of Search ..... 63/4, 9, 27, 26; 59/80

[56] References Cited

U.S. PATENT DOCUMENTS

| | | | |
|---|---|---|---|
| 365,115 | 6/1887 | Bigeney | 59/80 |
| 717,555 | 1/1903 | Dover | 63/20 |
| 1,276,607 | 9/1818 | Anderson | 59/80 |
| 1,405,851 | 2/1922 | Lewis | 59/80 |
| 1,573,927 | 2/1926 | Fulford | 59/80 |
| 1,788,552 | 1/1931 | Speidel | 59/80 |
| 2,095,547 | 10/1937 | Girouard | 59/80 |
| 2,265,956 | 12/1941 | Schenck | 63/4 |
| 2,584,207 | 2/1952 | Holl | 63/4 |
| 2,852,923 | 9/1958 | Gamelsky | 59/80 |
| 4,360,969 | 11/1982 | Collier | 59/80 |
| 4,781,038 | 11/1988 | Branca et al. | 63/26 |

FOREIGN PATENT DOCUMENTS

| | | | |
|---|---|---|---|
| 163090 | 6/1904 | Fed. Rep. of Germany . | |
| 191165 | 12/1918 | Fed. Rep. of Germany . | |
| 2216050 | 1/1973 | Fed. Rep. of Germany . | |
| 3227276 | 2/1983 | Fed. Rep. of Germany . | |
| 473655 | 1/1915 | France | 59/80 |
| 27321 | of 1903 | United Kingdom | 59/80 |
| 2221715 | 2/1990 | United Kingdom | 63/4 |

*Primary Examiner*—Michael Milano

*Attorney, Agent, or Firm*—Fredrikson & Byron

[57] ABSTRACT

The invention relates to a chain link for gems comprising a mounting portion, a linking element disposed on the mounting portion and a receiving element provided on the mounting portion for taking up and connecting a linking element of a further chain link, the gem being simultaneously held captively by the fastening element in the mounting portion of this link member by engagement of the linking element of a first chain link with the receiving element of a further chain link. The invention also relates to a method for producing ornamental chains using the inventive chain links and to the ornamental chains themselves.

14 Claims, 2 Drawing Sheets

CHAIN LINK FOR GEMS, AND ORNAMENTAL CHAIN COMPRISING SUCH LINKS, AND A METHOD FOR PRODUCING SAID CHAIN

This application is a continuation, of application Ser. No. 07/836,064, filed Feb. 12, 1992, now abandoned.

The present invention relates to a chain link for gems, an ornamental chain comprising said chain links, and a method for producing said ornamental chain.

Chain links for gems are known from the prior art. They all share a mounting portion for taking up the gem and connecting elements provided on the mounting portions for interconnecting the individual chain links. These connecting elements are loops or rings provided laterally on the mounting portions which are linked together. Chains comprising such chain links are manufactured by first putting the gems in the mounting, fixing them therein by means of claws or similar fastening means. The individual chain links must subsequently be interconnected individually to form a chain.

The chain links known from the prior art are very unfavorable for producing chains of gems since particularly when substantially all links of the chain are to carry gems their production involves high labor consumption, which is necessarily reflected in the costs. It must be heeded that, in particular in the costume jewelry field, the setting costs for a stone many times exceed those of the stone itself. Furthermore, the interconnection of the individual chain links via rings or loops impairs the overall esthetics of the ornamental chain thus produced, Also, it highly restricts the selection of the form of the chain links, and thus also that of the gems to be attached thereto.

The present invention is based on the problem of providing a chain link for gems with which ornamental chains can be produced in a simple and inexpensive way. In particular, the chain links should not have the disadvantages known from the prior art.

The invention is based on the finding that this necessitates chain links which permit the stones to be mounted and the individual chain links to be interconnected in one operation.

The object of the present invention is a chain link for gems comprising a mounting portion for taking up a gem, fastening elements provided for holding the gem, a linking element disposed on the mounting portion for connecting the chain link to a further chain link, and a receiving means provided on the mounting portion for taking up and connecting a linking element of a further chain link, the gem being simultaneously held captively by the fastening elements in the mounting portion of this link member by engagement of the linking element of a first chain link with the receiving means of a further chain link, characterized in that the linking element is designed as a stem and the receiving means as an opening in the mounting portion, the linking element and the receiving means being adapted to be engaged with each other.

The object of the invention is also a method for producing ornamental chains with chain links characterized in that a gem is put in the mounting portion of a chain link, the receiving means is engaged with the linking element of a further chain link by putting the linking element in the receiving means, and the connection between the receiving means and the linking element is produced by compressing the mounting portion, the gem being simultaneously anchored and fixed captively in the mounting portion.

The object of the present invention is furthermore an ornamental chain comprising chain links of the claimed type.

The inventive chain links have the considerable advantage than they permit the gem to be mounted and the chain links to be connected in a single operation, This not only simplifies and speeds up the production of an ornamental chain comprising such links but also considerably reduces the production cost, As already mentioned, the costs for setting a stone usually exceed the costs of the stone itself, It must be taken into consideration that the dimensions of the stones must be precisely coordinated with the dimensions of the mounting produced therefor in order to ensure a certain hold of the gem in the mounting, This obviously requires enormous expenditures for apparatus, By contrast, the chain links of the inventive type make it possible for the gems to have considerable tolerances. Their certain hold is .ensured by the compression of the mounting portion until it is completely closed, so that the mounting portion adapts to the form of the stone in the area of its setting side.

The element provided for linking the chain links to the mounting portion is designed inventively as a stem and the receiving means as an opening in the mounting portion. The stem and opening are adapted to be engaged with one another, The inventive chain link can be produced particularly simply, in one casting so to speak, Snap-in locking devices are preferably provided to engage the stem and opening.

In a preferred embodiment, the stem engaging the opening is pivoted to the mounting portion by means of the snap-in locking device. This ensures in particular the suppleness and mobility of a chain formed therefrom, In a further preferred embodiment of the inventive chain link shown in FIGS. 6C and 7C, bores 7''' are provided in the stem and the opening has pins 8''' on the side edges as a snap-in locking device for anchoring the chain links to one another. The bore in the stem can suitably be a through bore. The pins engage the bores in the stem of a further mounting portion upon compression of the mounting portion. The adjacent chain links are therefore reliably anchored to one another. In a further preferred embodiment shown in FIGS. 6A and 6B, pins 8' can conversely be provided on the stem and the bores 7' on the sides of the opening.

All preceding embodiments of the inventive chain link create great suppleness in a chain formed therefrom since the individual links are easily swiveled, in particular perpendicular to one another.

In a further preferred embodiment shown in FIGS. 6B and 7B, semispherical sockets are 7'' provided on the sides of the opening and the stem has a joint head 8'' adapted to be engaged with these sockets for joining together the links. The advantage of this embodiment is that the individual chain links can be swiveled in all directions relative to one another which is very advantageous in bracelets, for example.

In a further embodiment of the present invention the links can be joined together by providing notches on the sides of the opening in the mounting portion and giving the stem snap-in projections which engage these notches. In this embodiment the chain links can be swiveled relative to one another particularly in the horizontal direction with respect to the mounting. An ornamental chain formed therefrom is thus particularly suitable when a certain rigidity is required, for example in necklaces.

In a further embodiment the mounting portion of the chain link has a border all around its upper peripheral edge as a fastening element for the gem. However, so-called claws can also be provided in a suitable way for attachment. For the gem to be reliably held in the mounting portion of the chain link, it is advantageous if the inner side of the mounting portion has a conical design.

The production of an ornamental chain with the inventive chain links is extremely simple and can even be performed by inexperienced persons. The connection between the individual chain links is achieved simply by introducing a linking element of one chain link into the receiving means of another chain link by compressing the mounting portion. This compression can be performed by hand or by machine.

In the following the invention shall be explained with reference to drawings of a preferred embodiment of the chain links, in which.

Figure 1:
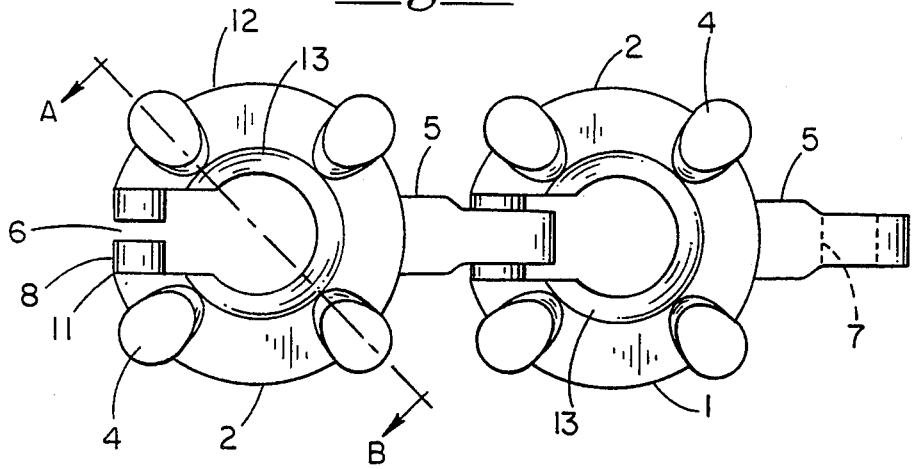
FIG. 1 shows a front view of two interconnected chain links of a preferred embodiment.

FIG. 1 shows the connection of two chain links 1 with each other. The chain links correspond to one of the preferred embodiments. Each chain link 1 has a mounting portion 2, a linking element 5 and a receiving means 6 for taking up and connecting a further chain link 1, and fastening elements 4 for holding gems.

In the embodiment shown, the mounting portion is bent in a circular shape and its inner side 13 tapers downwardly. This makes it particularly suitable for taking up so-called chatons as gems. However, any other form of mounting portion 2 is also conceivable, for example an oval. rectangular or polygonal form, or a figured form like a heart.

Linking element 5 is designed as a stem having a bore 7 for anchoring. Bore 7 is a through bore. Receiving means 6 is designed as an opening in mounting portion 2. In other words, mounting portion 2 is open on the side opposite the stem. Edges 11 of the opening show opposed pins 8. Pins 8 are pressed into bore 7 so as to join chain links 1 together, as shown. The thickness of pin 8 must correspond approximately to the diameter of bore 7 to ensure a positive and frictional connection. However, the diameter of bore 7 is preferably slightly greater than that of the pins so as not to impair the swiveling ability of the chain links relative to one another. It is therefore also necessary for play to remain between the stem and edges 11 of the opening after links 1 are joined together. In the embodiment shown, the stem thus tapers in its end area facing away from the mounting portion. This is a possible, but not necessary, measure.

In the embodiment shown, claws are provided as fastening elements 4 on upper peripheral edge 12. The number of claws can be freely selected and depends essentially on the size of the gem to be fixed therewith.

With respect to the claws or a possible border as fastening element 4, it must be said that the inventive chain link has a further advantage in comparison to known chain links for gems. The claws or the border need no longer be closed around the gem; they are instead already in the end position in the prefabricated chain link and the stones are brought to the claws upon simultaneous insertion and interconnection of the links.

Figure 2:
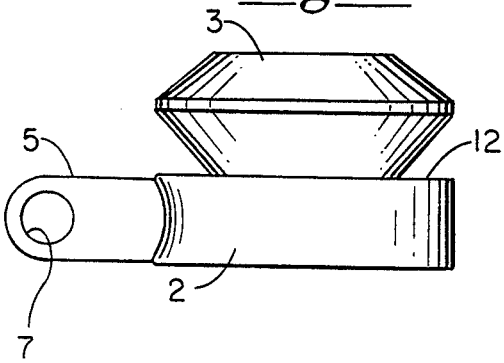
FIG. 2 shows a side view of this chain link.

FIG. 2 shows a schematic view of the preferred chain link in a side view. A gem 3 is inserted into mounting portion 2. Linking element 5, which is again designed as a stem, has a bore 7 laterally. This representation makes it particularly apparent that two joined chain links can be swiveled perpendicular to each other.

Figure 3:
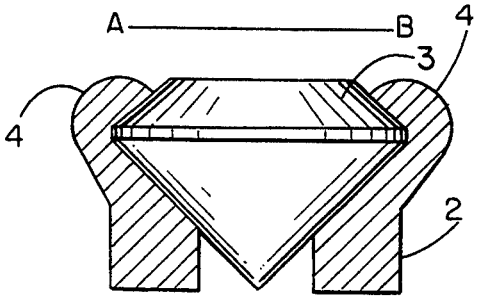
FIG. 3 shows a section in direction A-B through the mounting portion.

FIG. 3 shows a vertical section through a mounting portion 2 with claws as fastening element 4.

Figure 4:
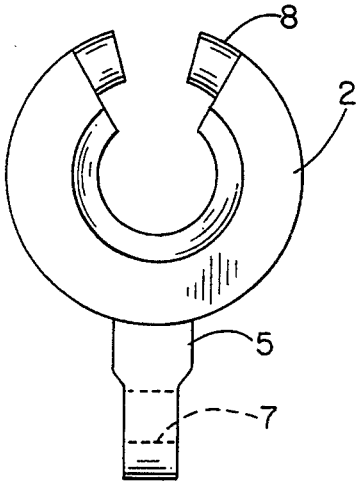
FIG. 4 shows the inventive chain link in the open state.
Figure 5:
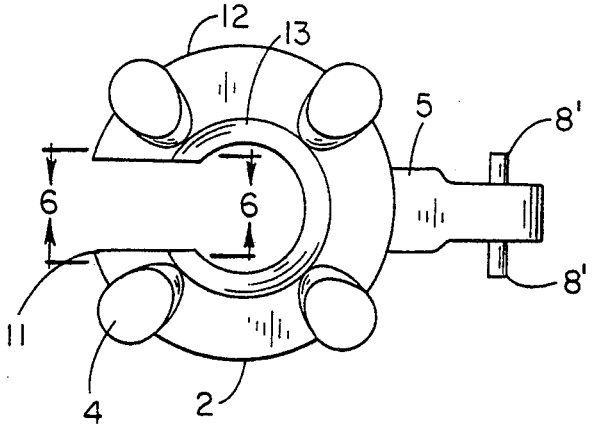
FIG. 5 shows an alternate embodiment of the chain link.
Figure 6A:
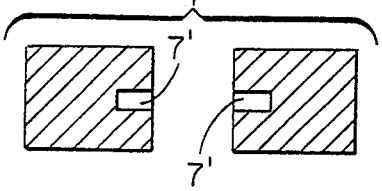
FIGS. 6A–6C show alternate embodiments of the chain link.
Figure 7A:
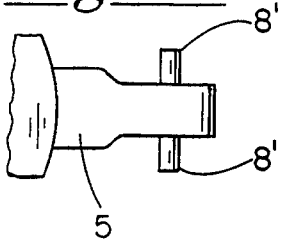
FIGS. 7A–7C show alternate embodiments of the chain link.
Figure 6B:
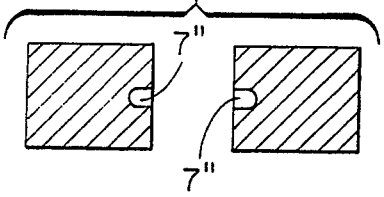
Figure 7B:
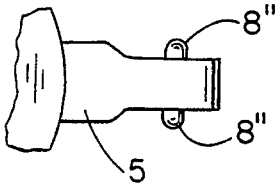
Figure 6C:
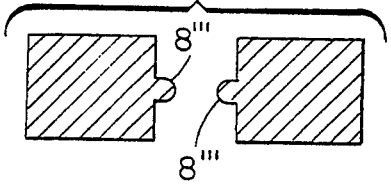
Figure 7C:
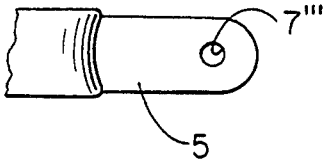

FIG. 4 shows the inventive chain link from the front and in a slightly bent-open state. Mounting portion 2 is slightly open for introduction of a gem. It can be bent together by machine or by hand.

Suitable materials for producing the chain links are all those known for this purpose in the jewelry industry. Within the framework of the invention one can use injection molded plastic parts, which have the advantage that the plastics can be colored in a great variety of nuances. All metals or metal alloys are of course also suitable. However, it is preferable to use precious metals such as gold, silver or platinum. The gems used are in particular cut glass stones, for example chatons. One can of course also use all semiprecious stones, such as zircon, amethyst, onyx and the like. But all precious stones are also conceivable.

The embodiments shown in the drawings are not the only ones possible. The request for protection also includes embodiments which are not stated verbatim. For example, it is conceivable to join the links together using snap connections hinged to the mounting portions which can be engaged with the linking element. Any type of positive and frictional engagement is fundamentally conceivable. It need not be specially mentioned that chain links without gems can also be used, so-called blind links.

I claim:

1. A link for forming an ornamental chain of mounted gems comprising a mounting portion and a fastening element for receiving a gem; the mounting portion including a receiving means having an open and a closed position and a linking element and the fastening element having an open position for receiving a gem and a closed position for fixing the gem in the link; one of the linking element or the receiving means of the mounting portion comprising a pair of generally opposed pins and the other of the linking element or the receiving means comprising a recess for receiving the pins, the receiving means being sized in its open position to receive the linking element of a like link so that when the receiving means of one link is urged into its closed position it will simultaneously urge the pins into the recess and urge the fastening element into its closed position to fix a gem.

2. The invention of claim 1 wherein the linking means is formed on the side of the mounting portion opposite the receiving means.

3. The invention of claim 1 wherein the pins are pivotally received in the recess.

4. The invention of claim 1 wherein the recess comprises a bore through the linking element.

5. The invention of claim 1 wherein the pins are carried by the linking element and the recess is provided in the receiving means.

6. The invention of claim 1 wherein the pins are generally semispherical in shape and the recess is a pair of notches shaped to receive the semispherical pins.

7. The invention of claim 1 wherein the fastening element comprises a plurality of claws spaced about the upper peripheral edge of the mounting portion.

8. The invention of claim 1 wherein the fastening element comprises a border about the upper peripheral edge of the mounting portion.

9. The invention of claim 1 wherein an interior surface of the mounting portion is generally conically shaped.

10. The invention of claim 1 further comprising a plurality of said links wherein the pins of each link are received in the recess of another link.

11. A link for forming an ornamental chain of mounted gems comprising a bendable mounting portion and a fastening element for receiving a gem; the mounting portion including a receiving means having an open and a closed position and a linking element the fastening element having an open position for receiving a gem and a closed position for fixing the gem in the link; one of the linking element or the receiving means of the mounting portion comprising a pair of generally opposed pins and the other of the linking element or the receiving means comprising a recess for receiving the pins when the linking element is in its closed position so that when the receiving means of one link is urged into its closed position it will simultaneously urge the pins into the recess and urge the fastening element into its closed position to fix a gem.

12. A method of producing an ornamental chain comprising:

a) providing a plurality of links having a mounting portion and a fastening element for receiving a gem; the mounting portion including a receiving means having an opening for receiving a linking element, the linking element and the receiving means being adapted to be engaged with one another; the fastening element having an open position for receiving a gem and a closed position for fixing the gem in the link;

b) placing a gem in the fastening element of a first link in its open position;

c) positioning the linking element of a second link within the opening of the receiving means of the first link; and d) urging the fastening element of the first link toward its closed position to simultaneously fix the gem in the fastening element and urge the opening of the receiving means of the first link closed to engage said receiving means of the first link and the linking element of the second link.

13. The method of claim 12 wherein one of the linking element or the receiving means of the mounting portion comprises a pair of generally opposed pins and the other of the linking element or the receiving means comprises a recess for receiving the pins, wherein urging the fastening element toward its closed position simultaneously positions the pins within the recess.

14. The method of claim 12 further comprising:

a) placing a gem in the fastening element of the second link in its open position;

b) positioning the linking element of a third link within the opening of the receiving means of the second link; and c) urging the fastening element of the second link toward its closed position to simultaneously fix the gem in the fastening element and urge the opening of the receiving means of the second link closed to engage said receiving means of the second link and the linking element of the third link.

* * * * *